US010245464B2

(12) United States Patent
Lopes Rodrigues

(10) Patent No.: US 10,245,464 B2
(45) Date of Patent: Apr. 2, 2019

(54) SQUAT RACK FOR GROUP FITNESS CLASSES

(71) Applicant: Celso Lopes Rodrigues, Praia (CV)

(72) Inventor: Celso Lopes Rodrigues, Praia (CV)

( * ) Notice: Subject to any disclaimer, the term of this patent is extended or adjusted under 35 U.S.C. 154(b) by 0 days.

(21) Appl. No.: 15/268,727

(22) Filed: Sep. 19, 2016

(65) Prior Publication Data

US 2017/0080276 A1 Mar. 23, 2017

(30) Foreign Application Priority Data

Sep. 19, 2015 (PT) ..... 108824

(51) Int. Cl.

| | |
|---|---|
| ***A63B 23/04*** | (2006.01) |
| ***A63B 21/00*** | (2006.01) |
| *A63B 21/078* | (2006.01) |
| *A63B 23/12* | (2006.01) |
| *A63B 21/072* | (2006.01) |
| *A63B 21/068* | (2006.01) |

(52) U.S. Cl.

CPC ..... *A63B 23/0405* (2013.01); *A63B 21/4035* (2015.10); *A63B 21/0004* (2013.01); *A63B 21/068* (2013.01); *A63B 21/078* (2013.01); *A63B 21/0724* (2013.01); *A63B 23/1218* (2013.01); *A63B 23/1227* (2013.01); *A63B 2023/0411* (2013.01); *A63B 2210/00* (2013.01); *A63B 2225/093* (2013.01); *A63B 2225/682* (2013.01); *A63B 2225/687* (2013.01)

(58) Field of Classification Search

CPC ..... A63B 21/0004; A63B 21/068; A63B 21/0724; A63B 21/078; A63B 21/4035; A63B 23/0405; A63B 23/1218; A63B 23/1227; A63B 2225/687; A63B 2225/093; A63B 2225/682; A63B 2210/00; A63B 2023/0411; A63B 1/00; A63B 3/00; A63B 9/00; A63B 17/00; A63B 17/02; A63B 17/04; A63B 21/00047; A63B 21/0005; A63B 21/00054

See application file for complete search history.

(56) References Cited

U.S. PATENT DOCUMENTS

| | | | | |
|---|---|---|---|---|
| 4,555,107 | A * | 11/1985 | Otto | A63B 3/00 482/42 |
| 8,613,692 | B2 * | 12/2013 | Baudhuin | A63B 21/00072 297/239 |
| 9,744,396 | B1 * | 8/2017 | Leath | A63B 21/012 |
| 2002/0098954 | A1 * | 7/2002 | Buechel | A63B 3/00 482/96 |
| 2009/0124471 | A1 * | 5/2009 | Storch | A63B 21/00047 482/141 |
| 2010/0137115 | A1 * | 6/2010 | Storch | A63B 21/00047 482/141 |
| 2017/0216657 | A1 * | 8/2017 | Hoobler | A63B 69/0057 |

* cited by examiner

*Primary Examiner* — Megan Anderson

(74) *Attorney, Agent, or Firm* — The Roy Gross Law Firm, LLC; Roy Gross

(57) ABSTRACT

A squat rack for group fitness exercises specifically designed for storability and mobility. Storability is achieved by making one of the edges narrower than the other allowing one unit to fit in another. Mobility is achieved through two small wheels placed on one edge and a set of handles on the opposite edge. The rack is to be used in group classes in gyms, health clubs and other sport venues.

7 Claims, 3 Drawing Sheets

SQUAT RACK FOR GROUP FITNESS CLASSES

FIELD OF THE INVENTION

This invention is a movable squat rack for group fitness classes. It comprises a barbell rack specifically designed for group classes in gyms, health clubs and other sport venues.

BACKGROUND OF THE INVENTION

In addition to overall physical fitness, the objective of a large segment of gym and health club clients is that of developing, shaping and toning muscles. Furthermore, there is particular focus on the leg and gluteus muscles in the female segment. Given these objectives, the most sought after activities are weight-training and targeted muscle training.

An essential piece of equipment for weight-training is the squat rack, a rack designed to hold a barbell. This piece of equipment is used to perform the back squat, an exercise considered to be one of the most complete particularly for the legs, glutes and core. This piece of equipment is also used for other variations of the squat, various types of lunges and a wide range of exercises for other muscle groups.

Weight-training is a highly effective form of training that produces results in a relatively short period of time. However, despite its effectiveness a large segment of the training population is uncomfortable in a weight room environment. This causes many people to prefer group classes targeted at specific muscle groups despite their inferior effectiveness with regards to the quality and speed of results when compared to weight-training.

Currently, the squat rack is exclusively found in weight-training rooms. The racks are not movable, their shape and size make them inadequate for fitness studios and it is very difficult to store a large quantity of racks in a studio after use.

Therefore, targeted muscled training classes such as "Body Pump", "GAP", "MIB" (Made in Brazil) amongst others, use an unsupported (no rack) weighted barbell supported only by the users' shoulders to exercise the legs through squats and lunges. The lack of proper support for the barbell during these classes presents the following limitations and risks:

1. For participants in general, and particularly for beginners, it is unsafe to perform squats and lunges supported by the shoulders without the extra support of a barbell rack. The lack of support reduces the safety and control of movement. This also applies to exercises for other muscle groups such as biceps, triceps and the back muscles.
2. With regards to intermediate and advanced participants, the lack of support does not allow the use of the correct load for the legs and glutes, which are the most powerful muscles in the human body. Therefore a load that a practitioner can raise manually (using the arms) off the floor and place on his/her trapezoids (or anterior deltoids in the case of the front squat) is generally insufficient to effectively stimulate the leg and glute muscles. This is particularly true for squats but also applies to lunges.
3. There is a high level of risk involved with handling loads in order to achieve adequate stimulus for the legs and glutes. Consequently, a large number of accidents and injuries occur during the process by which the participant places, or removes, the loaded barbell on his/her shoulders.

4. The risks of poor form are heightened due to the lack of a physical reference to aid the participant in the orientation and control of the movements.
5. The participants carry the loaded barbell on their shoulders for an excessive amount of time (various minutes) while they perform the full range of leg exercises which are performed with almost no rest periods.
6. The participants are unable to adjust the load (weight) to the different exercise types during the entire session. This results in the use of inadequate loads for certain exercises. For example, the adequate load for squats is very different to the adequate load for lunges.

SUMMARY OF THE INVENTION

The objective of the invention is to adapt the squat rack to group classes. To achieve this, the traditional barbell rack used in weight rooms must undergo significant changes to produce a model that is specifically adapted for fitness studios:

1. The squat rack will be similar to the traditional squat rack found in weight rooms, however, it will be smaller, lighter and mobile. Mobility is achieved through two small wheels placed on one edge and a set of handles on the opposite edge. The wheels only touch the floor when the equipment is raised from the opposite edge (see FIG. 1 and FIG. 2).
2. The most important aspect of the design is that one of the edges is narrower than the other thus allowing one unit to fit in another (see FIG. 1 and FIG. 2) similar to the way supermarket karts and airport baggage trolleys are stored (see FIG. 3). This feature allows for the storage of a large number of units in a small area (e.g. studio) after use.
3. In addition to the variety of squats, lunges, dips and pull-ups that the rack can accommodate, with the addition of adequate benches the rack can also be used for the bench press, incline press and shoulder press.
4. As with the traditional rack, the adapted rack will include various heights for barbell support so that it can be adjusted to fit the user's height. Other additional features could include: plate holders, water bottle holders, and others.

DETAILED DESCRIPTION OF THE DRAWINGS

Figure 1:
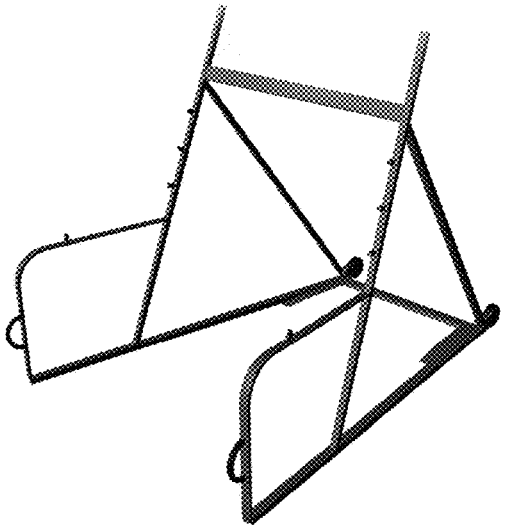
FIG. 1 shows a perspective view of a squat rack of an embodiment of the invention.
Figure 2:
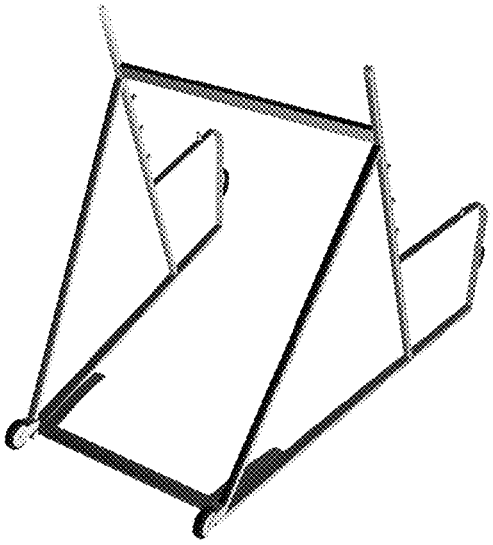
FIG. 2 shows a rear perspective view of the squat rack of FIG. 1.
Figure 3:
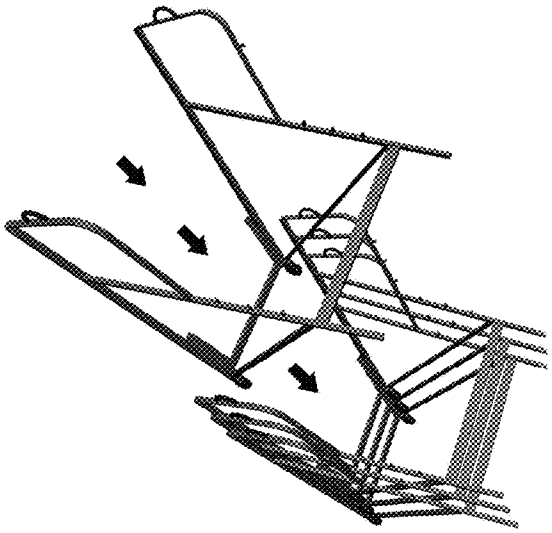
FIG. 3 shows a perspective view of the squat rack of FIG. 1 inserted into other corresponding squat racks.

FIGS. 1 and 2 show a pair of vertical rack members (1), crossbar (2), pair of vertical support members (3), pair of base members (4), floorbar (5), pair of horizontal support members (6), plurality of bar supports (7), two wheels (8), set of handles (9) and plate holder (10). The rack's mobility and storability could make it a standard piece of equipment in fitness studios thus presenting the following advantages for group classes:

1. The rack allows the use of adequate loads for the various muscle groups, particularly the legs and glutes, and allows participants to use heavy loads similar to those used in weight rooms.

2. The rack allows the easy and safe change of weights in order to adjust the load to the different exercise types, different series and different class objectives.
3. The rack allows the participant to rest the barbell on the rack pins whenever necessary and in the rest periods between series.
4. The rack increases the level of safety in the class particularly in relation to the handling of weights and execution of movements.
5. The rack allows for the integration of the main weight-training methods and systems with group classes to create a new class model which combines the pleasure of group classes with the efficiency of weight-lifting.

The process described in this document, of applying structural changes to a piece of equipment in order to enhance its functionality for Fitness is very similar to the process used to create the Spinning class. To create Spinning, Johnny G. transformed the conventional bicycle to create a new exercise model combining an adapted piece of equipment (the spinning bike) with its specific class methodology (the spinning class).

The invention claimed is:

1. A stackable squat rack designed for storability and mobility, comprising a pair of vertical rack members angled on an incline from a vertical position and connected via a crossbar; a pair of vertical support members each connected to a respective vertical rack member of the pair of vertical rack members, the pair of vertical support members configured to support the pair of vertical rack members; a pair of base members connected to each other via a floorbar, said pair of base members adapted to engage a floor surface, said pair of base members each connected to a respective vertical rack member of said pair of vertical rack members and to a respective vertical support member of said pair of vertical support members; a pair of horizontal support members each connected to a respective portion of said pair of vertical support members at one end and to a respective base member of said pair of base members at another end; a plurality of bar supports boated on the pair of vertical support members and said pair of horizontal support members; and two wheels connected to an end of said pair of base members, wherein each of the two wheels are connected to a respective base member of the pair of base members, wherein the pair of base members are angled such that the stackable squat rack is narrower at its rear than its front to allow the stackable squat rack to fit into another stackable squat rack of similar configuration for storage.

2. The stackable squat rack of claim 1, further comprising a set of a handle located on each of the pair of horizontal support members.

3. The stackable squat rack of claim 1, wherein said squat rack is specifically designed for storability and mobility.

4. The stackable squat rack of claim 1, wherein said squat rack is made of metal or a metal alloy.

5. The stackable squat rack of claim 1, wherein the two wheels are configured to only touch the floor surface when the stackable squat rack is raised from the front of the stackable squat rack.

6. The stackable squat rack of claim 1, wherein the stackable squat rack is adjustable to fit a user's height.

7. The stackable squat rack of claim 1, further comprising a plate holder.

* * * * *